US006474980B2

(12) United States Patent
LaVanier

(10) Patent No.: US 6,474,980 B2
(45) Date of Patent: Nov. 5, 2002

(54) CANDLE WITH CLEAR BARRIER AND MEDIUM

(75) Inventor: Kathy LaVanier, Reynoldsburg, OH (US)

(73) Assignee: Bath & Body Works, Inc., Reynoldsburg, OH (US)

( * ) Notice: Subject to any disclaimer, the term of this patent is extended or adjusted under 35 U.S.C. 154(b) by 17 days.

(21) Appl. No.: 09/731,379

(22) Filed: Dec. 6, 2000

(65) Prior Publication Data

US 2002/0102508 A1 Aug. 1, 2002

(51) Int. Cl.[7] ..... F21V 35/00
(52) U.S. Cl. ..... 431/126; 431/291; D26/11
(58) Field of Search ..... 431/126, 288, 431/289, 291; 44/275; D26/9, 11

(56) References Cited

U.S. PATENT DOCUMENTS

| | | | | |
|---|---|---|---|---|
| 589,173 A | | 8/1897 | Henke | |
| 2,189,746 A | * | 2/1940 | Candy, Jr. | 431/291 |
| 2,315,803 A | | 4/1943 | Lipari | |
| 2,354,343 A | | 7/1944 | Webber et al. | |
| 3,077,981 A | | 2/1963 | Gaspard | |
| 3,495,924 A | | 2/1970 | Doering, et al. | |
| 3,501,256 A | | 3/1970 | Milliken | |
| 3,741,711 A | | 6/1973 | Bryant | |
| 3,744,957 A | | 7/1973 | Wright, Sr. | |
| 3,761,702 A | | 9/1973 | Andeweg | |
| 3,773,460 A | | 11/1973 | Tellier | |
| 3,890,085 A | | 6/1975 | Andeweg | |
| 4,017,729 A | * | 4/1977 | Frazier, Jr. | 431/291 |
| 4,163,333 A | | 8/1979 | Kwiatkowski | |
| 4,225,552 A | | 9/1980 | Chang | |
| 4,427,366 A | | 1/1984 | Moore | |
| 4,567,548 A | | 1/1986 | Scheeberger | |
| 4,818,215 A | | 4/1989 | Taga | |
| 4,826,428 A | * | 5/1989 | Lam | 431/291 |
| 5,395,233 A | | 3/1995 | Karp | |
| 5,597,300 A | | 1/1997 | Wohl et al. | |
| 5,632,615 A | | 5/1997 | DeGarmo | |
| 5,697,694 A | | 12/1997 | Cutts | |
| 5,951,278 A | * | 9/1999 | Young et al. | 431/291 |
| 5,975,725 A | | 11/1999 | Ireland-Stacy | |
| 6,033,210 A | | 3/2000 | Freeman | |
| 6,059,564 A | * | 5/2000 | Morris | 431/291 |
| 6,241,512 B1 | * | 6/2001 | Freeman et al. | 431/291 |
| 6,290,489 B1 | * | 9/2001 | Seidler | 431/289 |

OTHER PUBLICATIONS

Thomas, L., *Gel Candles, how to Make & Market Gel Candles That Sell Like Wildfire*! 2001, Net Partners Publishing, 2$^{nd}$ Edition, p. 52.*

* cited by examiner

*Primary Examiner*—Sara Clarke
(74) *Attorney, Agent, or Firm*—Colucci & Umans; Peter C. Michalos; Angelo Notaro

(57) ABSTRACT

A candle has a core of solid fuel that can be burned by a flame on a wick in the fuel. A flame resistant and heat resistant barrier is around the core, the barrier being at least partly transparent for passing light from the flame. A clear, rigid, outer shell of shell material around the barrier passing light from the flame to an outer surface of the shell. An opaque pattern is on the barrier for projecting an image of the pattern with light from the flame and a translucent wrap at the outer surface of the shell receives the projected image of the pattern. Alternatively, decorative items are in the shell which are visible through the transparent material of the shell and are protected from the heat of the flame by the barrier.

14 Claims, 4 Drawing Sheets

CANDLE WITH CLEAR BARRIER AND MEDIUM

FIELD AND BACKGROUND OF THE INVENTION

The present invention relates in general to candles, and in particular to a new and useful candle with a heat barrier which is partly or entirely clear or transparent, and a medium outside the barrier which is clear or transparent and which either contains one or more decorative items, or is free of everything but the medium.

The clear medium and a wax or wax-like fuel material for burning which is inside the barrier, may be any one of a variety of clear waxes or wax-substitutes such as one of the ester-terminate polyamides (ETPA) disclosed in U.S. Pat. No. 5,998,570 to Pavlin, et al. issued Dec. 7, 1999 or U.S. Pat. No. 5,783,657 to Pavlin, et al. issued Jul. 21, 1998, which are both incorporated here by reference. An example is a product know by the trademark UNICLEAR for an ETPA sold by the owner of these patents.

Also see U.S. Pat. No. 5,578,089 to Elsamaloty for another clear candle materiel which can be used for the present invention.

Also see U.S. patent application Ser. No. 09/516,140, filed Mar. 1, 2000 and entitled PRODUCTS WITH ETPA-BASED ICONS, owned by the assignee of the subject application and also incorporated here by reference.

U.S. Pat. No. 2,354,343 to Webber et al. discloses a shield or barrier made of non-flammable metal or plastic material that is opaque or transparent and that is inserted into the body is of a large diameter candle. A particular plastic that is disclosed for use is ethyl cellulose and similar compositions.

U.S. Pat. No. 3,741,711 to Bryant discloses a pillar candle having a glass cup supporting a combustible portion of the candle inside a cylinder of insulating material and a second, larger cylinder of glass. The glass cylinder is embedded in an outer body of candle material. The glass cup does not extend the entire depth of the pillar candle. The insulating and glass cylinders are covered by a thin layer of candle material to hide them from view. The rim of the glass cup is visible on the top of the candle.

U.S. Pat. No. 5,395,233 to Karp teaches a pillar candle having an outer shell of wax, an intermediate cylindrical layer of transparent wax and potpourri and an inner core comprising a combustible candle with a wick. The inner core has a sufficiently large diameter that the intermediate and outer layers do not melt or burn. The candle of Karp does not include a barrier.

Patents teaching patterns illuminated by candle flames include U.S. Pat. No. 3,773,460 to Tellier for a clear wax candle having an optical lens. In one embodiment of the candle, a lens insert made of wax is positioned in the candle below the wick which can be used to project an image and diffuse light from the candle flame. When the exposed surfaces of the lens cavity are pigmented, a pattern can be generated which reflects onto the outer surface of the candle.

U.S. Pat. No. 589,173 to Henke teaches a toy having a pattern cylinder with pattern openings that permit light from a candle burning inside the pattern cylinder to pass through onto spaced screens mounted on an outer frame. Heat rising from the candle is used to turn the pattern cylinder on an axis about the candle, so that the images formed by the pattern openings will move across the screens. The candle is a simple taper candle with a large air space between the candle and the pattern cylinder. The screens are also separated from the pattern cylinder by a gap.

U.S. Pat. No. 3,741,711 to Bryant discloses a reusable candle having surface ornamentation which is illuminated by the candle flame. The candle has a glass insert holding a core candle with a wick. The candle body is made of clear, undyed and unpigmented wax. The surface ornamentation is inscribed on the outermost surface of the candle body and illuminated from the candle flame passing through the candle body. The surface ornamentation is always visible.

A lampshade having a hidden image when the light source it is near is turned off is covered by U.S. Pat. No. 5,975,725 to Ireland-Stacy. A design or pattern is held between inner and outer layers of the lampshade to hide the design when the shade is not being illuminated.

A candle having a non-combusting light source, such as a light bulb, inside the candle for illuminating the candle is taught by U.S. Pat. No. 3,761,702 to Andeweg. The bottom of the candle is hollowed out and replaced with a light source. In one embodiment a clear sheath is inserted into the hollow. The sheath is disclosed as possibly having special light distributing or filtering qualities for light emanating from a light source contained therein.

A safety night light having a metal shield embedded in a glass container for a candle is disclosed by U.S. Pat. No. 2,315,803 to Lipari. The metal shield can have a pattern such as a mesh or honeycomb or spaced holes which light from the candle flame can pass through. The shield is a layer between the surfaces of the glass holder; the only candle material present is the candle inside the glass holder.

U.S. Pat. No. 3,077,981 to Gaspard teaches a candle having a design painted on the outer surface of a container which is illuminated by the candle flame inside the container. A disposable mailing tube for the candle is also provided which may have a similar design to that on the candle container. The mailing tube is discarded before using the candle.

Other patents of interest include U.S. Pat. No. 3,744,957 to Wright, Sr. for a candle made of an opaque wax which turns transparent when it melts. A disk with a design is placed just below the top surface of the candle around the wick, so that when the top layer of wax is heated by the candle flame, the disk is revealed.

U.S. Pat. No. 6,033,210, issued Mar. 7, 2000, on an application filed Jun. 21, 1999, discloses a candle with a wax core and surrounding gel components in a clear mineral oil gel, but no barrier around the core. The applicant for the present application reserves her right to swear behind U.S. Pat. No. 6,033,210, if needed.

U.S. Pat. No. 4,225,552 to Chang discloses a candle having a central core, an outer wax shell with wax decorative items embedded in the shell and a differential melting point between the shell material at a lower melting point and the core and items in the shell material at a higher melting point.

U.S. Pat. No. 4,427,366 to Moore discloses a core candle surrounded by scented chips.

SUMMARY OF THE INVENTION

An object of the present invention is to provide a pillar or jar candle having a flame barrier that is at least partly clear and which fits around a core of the candle and having a wick therein so that the core material can be burned. The barrier and core candle are surrounded by an outer solid body of clear candle material, for example, of wax or UNICLEAR material. The barrier is not combustible and prevents the outer body, as well as anything embedded in the outer body, from burning. Thus, the pillar candle has the outer appearance of a candle, but will not burn and change shape or design. In likewise fashion, the jar candle of the invention, that is a candle contained in a glass or other contained, may include decorative features which are protected from the heat of the burning wick, and which may even be advantageously illuminated by light from the candle flame.

The barrier material, when entirely clear, becomes essentially invisible inside the outer candle body when the fuel inside the barrier is also clear. The material used for the barrier is selected for a melt point that is higher than the temperature of heat generated by the flame of the core candle. In particular, the material may be a plastic which softens at 190° C., is pliable at 200° C. and melts at about 210° C. A preferred material for the barrier is polycarbonate.

The shape of the barrier may be varied to control the burn of the core candle. The barrier may taper toward the bottom, for example, rather than being a straight-sided cylinder or have another cross-sectional shape.

Another object of the present invention is to provide a pillar or jar candle having a flame barrier having a design painted or otherwise included onto one of the barrier surfaces and surrounded by a relatively clear outer candle shell. A paper or other translucent wrapping around the outer shell acts like a screen for receiving a projected image from the barrier pattern by light from the inner core as the candle burns. Light from the flame is projected through the unpainted or clear portions of the barrier onto the paper wrapping on the outer shell.

The barrier is preferably a clear plastic material which permits light to pass through. The design which is projected onto the paper screen is formed by painted opaque portions of ink or paint preferably on the outer surface of the barrier (away from the flame) and unpainted clear portions. UNICLEAR ETPS is a preferred material for the outer shell since light from the flame can pass through the clear unpainted portions of the barrier and through the shell while the opaque portions block the light. As the candle burns down, more light or more of the design will be apparent. If the inner core candle is transparent or translucent as well, the design is projected by light from the flame passing through the inner core to the barrier even before the core burns down.

Clear plastic material was found particularly suitable as the barrier since it was sufficiently impervious to a flame burning at the inner core to protect the outer structures of the candle. It was found that if glass was used as the barrier, the glass material retained too much heat from the flame causing the outer structures to slump and deform. This adverse effect did not occur when plastic was used as the barrier.

The candle of the invention does not have any air gaps between layers; each layer is in direct contact with the adjacent layer. The invention takes advantage of the transparent properties of the candle materials used to project the image from the barrier between the inner core candle and outer shell.

As noted, a preferred barrier is made of polycarbonate or the barrier may be polyester. In an alternate embodiment, the design is painted onto the inner surface of the barrier as a negative image. The inner core candle is placed or poured inside the painted barrier and then surrounded by a pour of UNICLEAR ETPA. An opaque wax can be used to cover the top edges of the layers to give the appearance of a conventional pillar candle. The outside is then covered with the paper or other wrap that has been treated with a fire retardant coating and glued in place. The wrap may be applied directly to the rigid outer surface of the pillar candle of the invention, or onto or inside a glass or other clear container for the jar candle of the invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
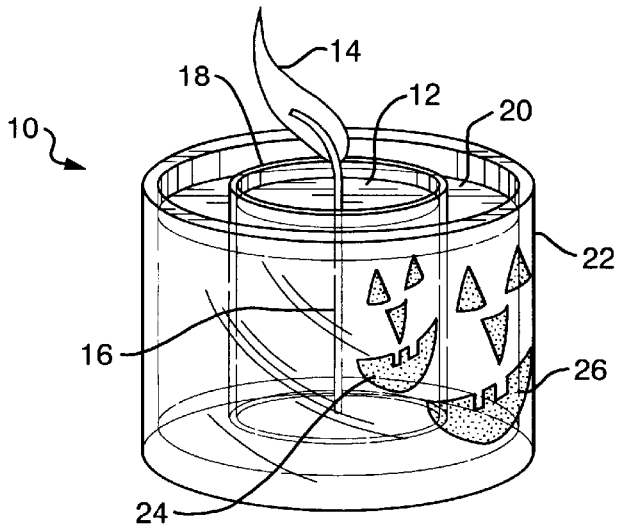
FIG. 1 is a perspective view of a first embodiment of the invention.

Referring to the drawings in which like reference numerals are used to refer to the same or functionally similar elements, the invention embodied therein in FIG. 1, is a candle 10 comprising a core of solid fuel that can be burned by a flame 14 on a wick 16 in the fuel. The wick is of know type and gauge for burning the fuel of core 12. The wick extends into the core and up out of the top of the core for burning the fuel.

A flame resistant and heat resistant barrier 18 is provided around the core. The barrier is at least partly, but preferably all transparent for passing light from the flame 14, out from the center of the candle. The barrier is preferably heat resistant plastic and about 0.01 to 0.1 inches thick. A clear, rigid, outer shell 20 of shell material about ½ inch thick from barrier to its outer surface, is placed around the barrier for passing light from the flame to an outer surface 22 of the shell.

Figure 2:
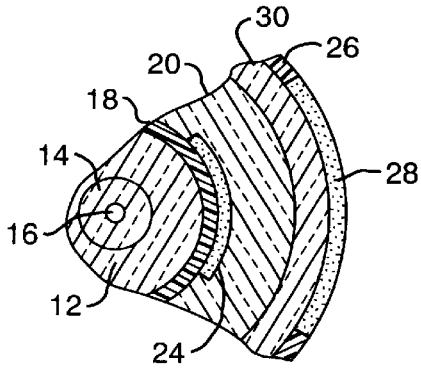
FIG. 2 is a fragmentary, top plan view of the first embodiment.
Figure 3:
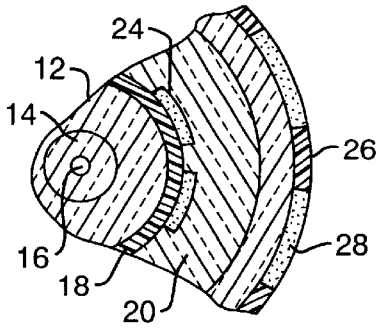
FIG. 3 is a view similar to FIG. 2 but of a second embodiment of the invention.

The candle 10 of FIG. 1 and FIG. 2, includes an opaque pattern 24 on the inner surface of barrier 18 for modifying light from the flame 14 for projecting an image of the pattern and a translucent wrap 26, e.g. of paper, at the outer surface 22 of the shell receives the projected image of the pattern at 28. As illustrated in FIG. 2, the shell may itself be contained in an outer container 30, e.g. of glass, onto which wrap 28 is glued, to from a jar candle, or as illustrated in FIG. 3, the shell 20 may be free standing with wrap 26 glued to the outer surface of the shell directly, and from a pillar candle.

In the embodiment of the invention where the candle includes an outer glass or other material container, rather than covering the surface of the container with paper to act as a screen, the inner or outer surface of the container, for example, the glass container, can be processed, for example, by frosting the surface. Known frosting techniques can be utilized by dipping the container into acid strong enough to etch the material of the container (creating a white etch effect), spraying an external translucent coating or tinted material onto the surface of the container, or sand blasting the glass to create a white etch effect.

In the embodiment of the invention which utilizes a paper wrapping 26 applied directly to the outer surface of the wax shell 20, after substantial research, the preferred form of the invention was to use a peel and stick arrangement where the paper wrap was pre-treated with a layer of adhesive and this adhesive was covered by a wax peel off layer in preparation for assembling the invention. The paper can be printed with any desired pattern so that the product is not totally plain when the candle is not burning (and thus projecting the hidden image onto the paper). The best adhesive was found to be a rubber based adhesive designed for labeling tires when used with tire wash. This adhesive exhibits high initial tack, yet is resistant to edge bleed and cold flow. This product is known as adhesive number P1110, and is available for Emulsion Technologies, Inc.

Two specific types of inks were tested and found suitable to create the opaque pattern 24 on the plastic barrier 18 in accordance with the present invention. The inks were applied by screen printing and can be applied to the inner or outer surface of the barrier.

Both inks are available from Tintas Sanchez,S.A. De C.V. of Mexico and are known by the brand names POLICAT and UNIPLAST.

The present invention also contemplates use of decoupage material to cover the outer surface of the candle. This method of using decoupage in accordance with the present invention is to apply a thick viscous liquid suitable for decoupage techniques, for example, products known as MOD PODGE GLOSS and MODE PODGE FLAT manufactured by Plaid Enterprises of Norcross, Ga. to the inner surface of the decoupage paper, applying the paper to the outer surface of the candle to wrap the candle, then applying another layer of decoupage material that is painted over the outer surface of the first layer to seal the inner layer and make sure it stays in place.

Figure 4:
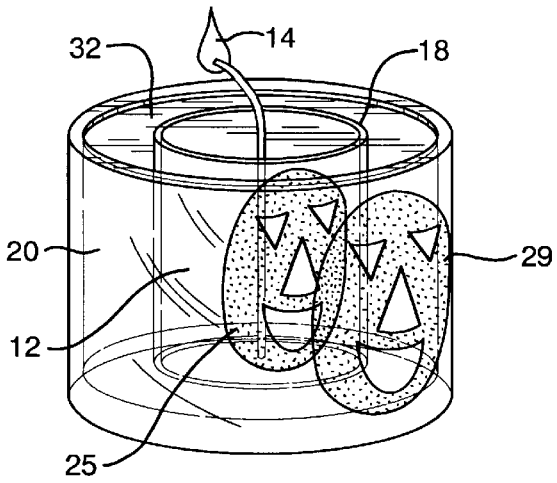
FIG. 4 is a view similar to FIG. 1 of a third embodiment of the invention.

FIG. 4 shows another embodiment of the invention where a pattern 25 is formed, e.g. of black paint or ink on the inner surface if barrier 18, and projects image 29 to the outer surface of the shell. Although both the core 12 an shell 20 may be clear, or the core may be translucent or opaque, a thin translucent or opaque layer of wax 32 may be applied over both to hide the top edge of barrier 18 and to make the candle look more like a common pillar candle. Top layer 32 also confines and reflects the light more effectively and thus intensifies the projected image 29, which, in any case, moves and shiners in an animated manner due to the normal flickering of flame 14.

Figure 5:
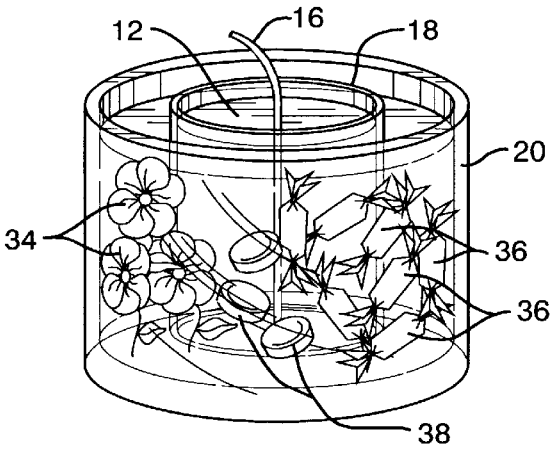
FIG. 5 is a view similar to FIG. 1 of a fourth embodiment of the invention.

FIG. 5 shows a candle according to the invention, which includes at least one decorative item such as a silk flower 34 or pieces of well-know brands of wrapped candy 36 or unwrapped candle 38, in the shell 20, which are visible through the transparent material or medium of the shell and protected from the heat of the flame by the barrier 18. The light from a flame on wick 16 also illuminated and animated the decorative items in a novel and entertaining way according to the invention. Although only a few items 34, 36 and 38 are shown, and these may be real items, or simulated versions of these items, the invention is meant to include at least one item in shell 20 or as many items as can be fit in the volume of shell 20. Non-limiting examples of the real items are candies, silk flowers or parts thereof, real flowers, berries or other botanicals or other small decorative items that fit in clear shell 20. The term "botanicals" is here used to include any real or simulated vegetable product such as flowers, flower petals, and like, but also to include whole and pieces of fruits, vegetables and other seemingly edible decorative items as well as plant parts, berries, twigs, leaves and the like. The term "candy" is meant to include wrapped and unwrapped candies which are commercially available and whose identities are easily recognized. Examples include brand name jellybeans, unmarked jellybeans, wrapped candies, such as "JOLLY RANCHERS" (a trademark), M&M brand candies and other candy items which, in the environment of the invention, are used as decorative items to enhance and add interest to the appearance of the candle and even camouflage the candle as other things, such as jars of preserved fruits, candy jars, jars of flowers or flower petals and other decorative arrangements that are not normally thought of as being candles.

Non-limiting examples of the simulated items may be cast from UNICLEAR, wax or other moldable, injectable or castable material.

Figure 6:
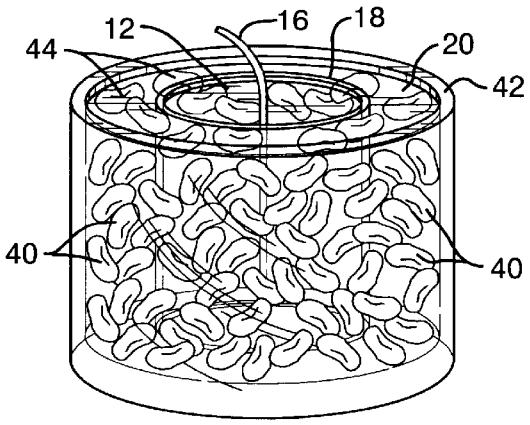
FIG. 6 is a view similar to FIG. 1 of a fifth embodiment of the invention.
Figure 7:
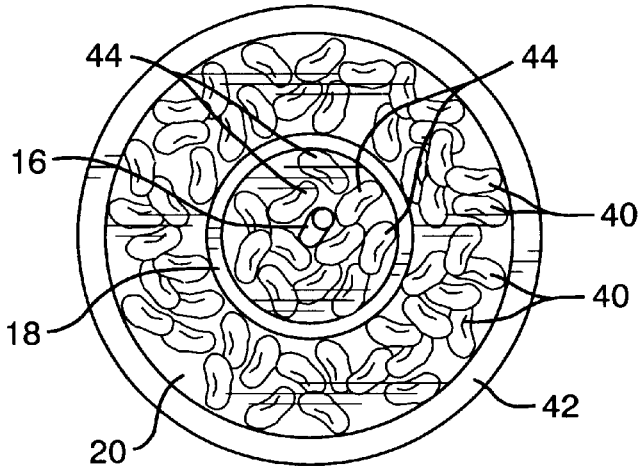
FIG. 7 is a top plan view of the fifth embodiment.

FIGS. 6 and 7 illustrate an example of the invention which comprises a barrier 18 filled with UNICLEAR-based gel 12 and a wick 16 for burning the gel, a clear UNICLEAR-based solid medium 20 abound the barrier, and real jellybeans of different colors 40, packed and substantially filling the shell 20. The shell medium may only be present in the voids between adjacent jellybeans. The shell and encases jellybeans are held within an outer glass wall or jar 42. A few jellybeans 44 are encases in an upper layer of the core material 12 so that it looks as though the jar 42 is a candy jar filled with jellybeans. Jellybeans 44 can also hid or obscure the top edge of the barrier 18 to further enhance the illusion of a jar of candy. The jellybeans 40,44 may be replaced with cast imitation jellybeans or any other real or simulated decorative items. The decorative items may also be mixed and of different types. For example, the jellybeans or items 44 at the top of core 12 may be a burnable wax or gel material, so as not to hamper burning by the wick 16, with real jellybeans or other decorative items 40 outside the barrier.

Figure 8:
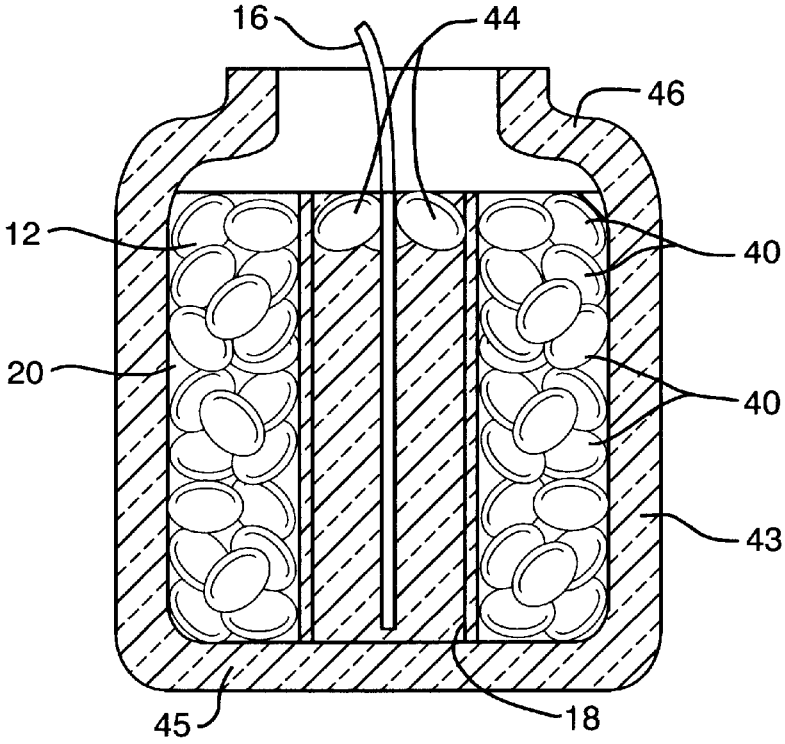
FIG. 8 is a side sectional view of a sixth embodiment of the invention.

FIG. 8 illustrates a variation of the embodiment of FIG. 6 and 7, where the outer glass container 43 is even more like a candy jar by including a neck 46 that can be closed by a top or lid (not shown).

Figure 9:
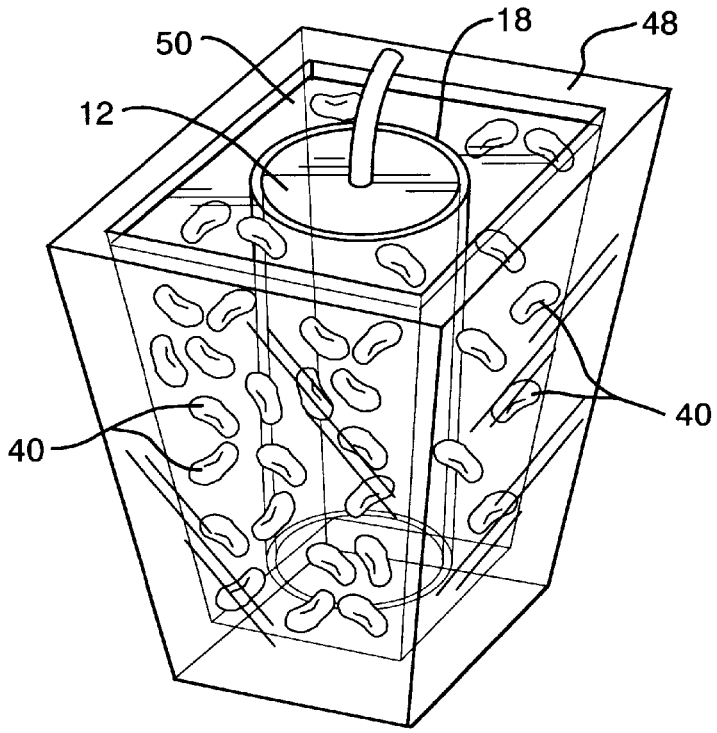
FIG. 9 is a view similar to FIG. 1 of a seventh embodiment of the invention.
Figure 10:
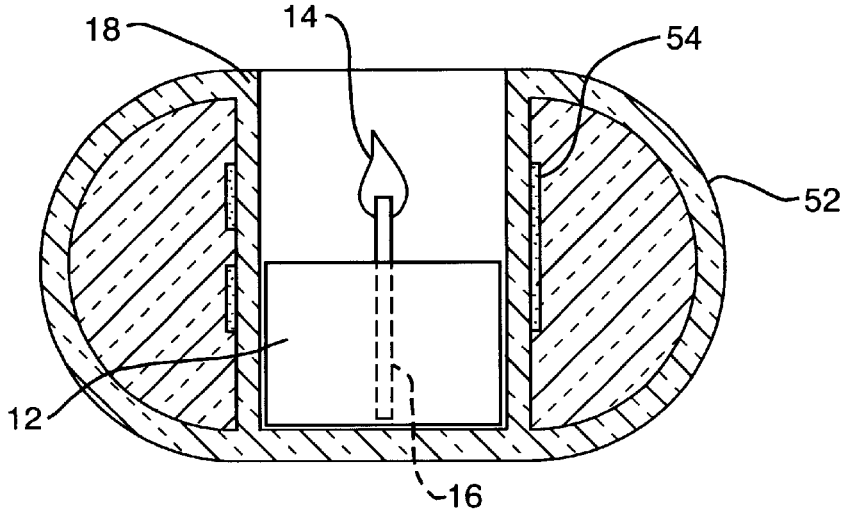
FIG. 10 is a side sectional view similar to FIG. 8 but of a seventh embodiment of the invention.

FIG. 9 illustrates the fact that the outer container 48 when it is present, or the shape of the outer surface of the shell 50, either with or without the paper of other screen material for the projector or hidden image version of the invention, can be any cross-sectional shape, i.e. square, pyramid-shaped, oval, rectangular, star-shapes, etc. FIG. 10 illustrates an embodiment of the invention which has a shell of container with an outer shape 52 that is spheroid or avoid in elevation and in section, with images 54 on or in barrier 18 that case a projected image onto an outer surface or surface material of the container or shell. To this end, the outer surface 52 can be frosted or otherwise treated to hold a projected image, or may be coated or carry a layer of translucent material that can hold the image. The vertically varying shape 52 has the further advantage of enlarging and/or reshaping the projected image from barrier 18, that is projected by light from the flame 14 of wick 16, burning the core fuel material 12.

Making the Candle

To manufacture candles of the invention, various methods can be used.

Method 1: Inside a candle mold, place flame barrier insert 18 around a preformed candle. Place icons or items on side of the insert away from candle. Over-pour preformed candle, insert and icons with appropriate candle making material to form finished product.

Method 2: Fill flame barrier insert with appropriate candle making material and allow to cool (optional—processing can continue while cooling/solidification occurs under proper system design). Place this combination inside of a candle mold, adding icons to the side of the barrier away from the candle making material Over-pour insert/candle making material and icons with appropriate candle making material (same as or different from original material) to form finished product.

Method 3: Using a pre-selected container, such as a jar, place flame barrier insert into jar. Place a preformed candle within insert. Place icons on side of insert away from the preformed candle. Over-pour preformed candle, insert and icons with appropriate candle making material.

Method 4: Using a pre-selected container, such as a jar, place flame barrier insert into jar. Fill flame barrier insert with appropriate candle making material and allow to cool/solidify (optional—processing can continue while cooling/solidification occurs under proper system design). Place icons on side of insert away from the candle material. Over-pour insert/candle material and icons with appropriate candle making material (same as or different from original material) to form finished product.

Compositions

Examples of the compositions for the core and shell, and, where wax-like material is used to cast the simulated decorative items or "icons" as they are sometimes called, the composition for the icons, are as follows.

CORE AND SHELL

| Ingredient | Preferred % by Weight | Permitted Range (wt %) |
|---|---|---|
| UNICLEAR 80 ETPA | 31.25 | 18–65 |
| Mineral Oil #7 | 37.25 | 20–75 |
| Capric/Caprylic Triglyceride | 25.00 | 0–35 |
| Myristic Acid | 2.00 | 0–7 |
| Hexylene Glycol | 2.00 | 0–7 |
| Fragrance | 2.50 | 0–12 |
| Pigment | 0 | 0 |
| Dye | 0.01 | 0–1 |

ICONS

| Ingredient | Preferred % by Weight | Permitted Range (wt %) |
|---|---|---|
| UNICLEAR 80 ETPA | 52.75 | 18–65 |
| Mineral Oil #7 | 44.74 | 35–82 |
| Capric/Caprylic Triglyceride | 0.00 | 0 |
| Myristic Acid | 0.00 | 0 |
| Hexylene Glycol | 0.00 | 0 |
| Fragrance | 2.50 | 0.1–12.0 |
| Pigment | 0.01 | 0–1 |
| Dye | 0.00 | 0 |

General Considerations

Barrier 18 and the various embodiments of the present invention serve several purposes. The barrier prevents the naked flame from coming into contact with the various icons or decorative items placed around the candle and beyond the barrier. In this capacity, the barrier serves as a safety device. The barrier sets the patterns for the burning properties of the candle. This means that the candle will burn in a manner that is controlled by the diameter and the design of the core fuel in the barrier. In most cases, this would be a straight down burn varying in diameter by the diameter of the barrier. The flame barrier also serves to preserve the aesthetic properties of the candle. This is achieved because the flame, which is restricted to the barrier area, does not consume the total candle. As a result at the end of the useful life of the candle, the consumer still has a decorate display item which is substantially the same in appearance as it was when it was first purchased.

The plastic material of the barrier should soften at a temperature of about 190° C., becomes pliable at a temperature of 200° C. and melts at a temperature of about 210° C. These tolerances can be controlled by selection and design of the polymer and can be achieved by those having ordinary skill in the field of plastics. The plastic must not readily support combustion, however, and should be invisible or nearly invisible when cased between the core and shell. As noted above, manufacturing can be by extrusion or molding.

While specific embodiments of the invention have been shown and described in detail to illustrate the application of the principles of the invention, it will be understood that the invention may be embodied otherwise without departing from such principles.

What is claimed is:

1. A candle comprising:

a core of solid fuel that can be burned by a flame on a wick in the fuel;

a wick extending in the core for burning the fuel;

a flame resistant and heat resistant barrier around the core, the barrier being at least partly transparent for passing light from a flame burning the fuel on the wick;

a clear, rigid, outer shell around the barrier for passing light from the flame to an outer surface of the shell; and an opaque pattern on the barrier for modifying light from the flame for projecting an image of the pattern, and translucent means at the outer surface of the shell for receiving the projected image of the pattern.

2. A candle according to claim 1 wherein the translucent means is a wrap of material around the outer surface of the shell for receiving the projected image of the pattern.

3. A candle according to claim 1 wherein the translucent means is a treatment of the outer surface of the shell for receiving the projected image of the pattern.

4. A candle according to claim 1 wherein the barrier is made of polycarbonate.

5. A candle according to claim 1 wherein the barrier is made of polyester.

6. A candle comprising:

a core of solid fuel that can be burned by a flame on a wick in the fuel;

a wick extending in the core for burning the fuel;

a flame resistant and heat resistant barrier around the core, the barrier being at least partly transparent for passing light from a flame burning the fuel on the wick;

a clear, rigid, outer shell around the barrier for passing light from the flame to an outer surface of the shell; and an outer transparent container outside the shell.

7. A candle according to claim 6 including at least one decorative item in the shell which is visible through the transparent material of the shell and protected from heat of the flame by the barrier.

8. A candle according to claim 7 wherein the decorative items are pieces of candy.

9. A candle according to claim 8 wherein the pieces of candy are wrapped.

10. A decorative item according to claim 5 wherein the decorative items are icons made of solid fuel material.

11. A candle according to claim 7 wherein the decorative items are actual items, each having a recognizable shape and identity, the candle including a plurality of icons in an upper layer of the core, each icon being made of solid fuel material and having the same recognizable shape and identity as the actual decorative items.

12. A candle according to claim 11 wherein the decorative items are selected from the group consisting of unwrapped candies, wrapped candies, botanicals, parts of botanicals.

13. A candle according to claim 7 wherein the decorative items are made of solid fuel material and have shapes corresponding to the group consisting of unwrapped candies, wrapped candies, botanicals, parts of botanicals.

14. A candle according to claim 6 wherein the barrier is made of plastic.

* * * * *